US005233936A

United States Patent [19]

Bellio

[11] Patent Number: 5,233,936

[45] Date of Patent: Aug. 10, 1993

[54] METHOD AND APPARATUS FOR DETECTING SKIPPED STITCHES FOR A CHAINSTITCH SEWING MACHINE

[75] Inventor: Stephen L. Bellio, West Roxbury, Mass.

[73] Assignee: The Charles Stark Draper Laboratory, Inc., Cambridge, Mass.

[21] Appl. No.: 759,410

[22] Filed: Sep. 13, 1991

Related U.S. Application Data

[63] Continuation-in-part of Ser. No. 577,852, Sep. 7, 1990, Pat. No. 5,140,920.

[51] Int. Cl.[5] ..... D05B 69/36

[52] U.S. Cl. ..... 112/273; 112/278; 112/197

[58] Field of Search ..... 112/273, 278, 271, 199, 112/202, 234, 197, 278; 250/559, 561, 562, 563; 66/163; 200/61.13, 61.18

[56] References Cited

U.S. PATENT DOCUMENTS

| | | | |
|---|---|---|---|
| 3,687,095 | 8/1972 | Jackson | 112/273 X |
| 3,738,296 | 6/1973 | MacKenzie et al. | 112/273 |
| 3,785,308 | 1/1974 | Brandriff et al. | 112/218 |
| 3,838,235 | 9/1974 | St. Germain | 200/61.18 |
| 3,885,161 | 5/1975 | Tarbox et al. | 250/559 X |
| 4,102,283 | 7/1978 | Rockerath et al. | 112/131 |
| 4,170,951 | 10/1979 | Dobrjanskyj | 112/278 |
| 4,186,672 | 2/1980 | Burton | 112/273 |
| 4,192,243 | 3/1980 | Blessing et al. | 112/273 |
| 4,196,685 | 4/1980 | Tamura | 112/273 |
| 4,325,314 | 4/1982 | Niem | 112/199 |
| 4,426,948 | 1/1984 | Olasz et al. | 112/273 |
| 4,602,582 | 7/1986 | Rawson | 112/278 |
| 4,693,196 | 9/1987 | Hager | 112/273 |
| 4,754,722 | 7/1988 | Rohr | 112/278 |
| 4,793,273 | 12/1988 | Hara et al. | 112/278 X |
| 4,805,544 | 2/1989 | Dobner et al. | 112/278 |
| 4,841,890 | 6/1989 | Tancs | 112/273 |
| 4,935,999 | 6/1990 | Lindemann | 200/61.18 X |
| 4,938,159 | 7/1990 | Shibata | 112/273 |
| 4,991,528 | 2/1991 | Bellio | 112/278 |
| 5,018,465 | 5/1991 | Hager et al. | 112/273 |
| 5,069,151 | 12/1991 | Bellio | 112/278 |
| 5,107,779 | 4/1992 | Arnold et al. | 112/278 |
| 5,140,920 | 8/1992 | Bellio et al. | 112/278 |

FOREIGN PATENT DOCUMENTS

| | | | |
|---|---|---|---|
| 3625963 | 7/1986 | Fed. Rep. of Germany . | |
| 0252625 | 12/1987 | Fed. Rep. of Germany | 112/278 |
| 0005316 | 2/1985 | Japan | 112/278 |
| 3270092 | 11/1988 | Japan | 112/273 |
| 3001896 | 1/1991 | Japan | 112/273 |
| 2008631 | 10/1978 | United Kingdom . | |

*Primary Examiner*—Clifford D. Crowder
*Assistant Examiner*—Ismael Izaguirre
*Attorney, Agent, or Firm*—Lahive & Cockfield

[57] ABSTRACT

Apparatus and method for detecting skipped stitches for chainstitch sewing machines having a looper assembly using a needle thread movement sensor and/or a looper thread movement sensor in combination with a shaft rotation sensor. Needle thread movement is correlated with needle shaft rotation per stitch cycle to detect instances when there is no needle thread movement during a stitch cycle. Similarly, looper thread movement may be correlated with needle shaft rotation per stitch cycle to detect instances when there is no looper thread movement during a stitch cycle. The invention includes methods for detecting needle loop and triangle skips by detecting instances of substantially no needle thread or looper thread movement during certain respective portions of the stitch cycle.

32 Claims, 6 Drawing Sheets

METHOD AND APPARATUS FOR DETECTING SKIPPED STITCHES FOR A CHAINSTITCH SEWING MACHINE

CROSS-REFERENCE TO THE RELATED APPLICATION

This is a continuation-in-part application of U.S. patent application Ser. No. 577,852 filed on Sep, 7, 1990, entitled "Apparatus for Detecting Skipped Stitches", now U.S. Pat. No. 5,140,920.

BACKGROUND OF THE INVENTION

1. Field of the Invention

This invention relates to an apparatus for monitoring the stitching quality of sewing machines and, in particular, to detecting skipped stitches for chainstitch sewing machines.

2. Description of the Related Art

With the clothing industry becoming increasingly automated, there is a need for systems that monitor and regulate the functions and output of high speed sewing equipment. Certain of these systems are utilized to monitor the stitching of sewing machines to detect skipped stitches in apparel manufactured by automated sewing machines.

In the general, improper stitches may from time to time be introduced in a workpiece manufactured with the use of an automated sewing machine. Generally, improper stitches may have the form of malformed stitches or skipped stitches. The incorporated reference U.S. patent application Ser. No. 557,852 describes malformed stitches and skipped stitches that arise in connection with lockstitch (class 301) sewing machines.

In the prior art, particularly for lockstitch sewing machines, skipped stitch detection systems are based upon monitoring the tension of the needle thread. As an example of this system, in U.S. Pat. No. 4,102,283 (Rockerath et al.) the loss of thread tension generally is said to correspond to a skipped stitch, and this reduction in normal thread tension triggers a sensing device. The sensitivity of these systems ranges from complete loss of thread tension, for example due to the thread breaking, to sensing a momentary reduction in normal thread tension. This system would be unable to effectively detect a triangle skip stitch.

Other systems are based upon monitoring thread consumption, and may correlate thread consumption with total number of stitches, to detect a skipped stitch. As an example of this system, in U.S. Pat. No. 3,843,883 (DeVita et al., Oct. 22, 1974) a monitor is used to measure thread consumption which is then compared to a predetermined standard of thread use, deviation from which activates an output signal.

A system used for detecting skipped stitches in a lockstitch type 301 sewing machine is disclosed in UK Patent Application No. GB 2008631. That system involve monitoring the length of a seam as compared with the upper thread consumption required to produce the seam. Actual thread consumption is then compared against a predetermined consumption value, any difference of which corresponds to an improperly formed seam. However, the difference in upper thread consumption between correct stitches and skipped stitches is not always substantial enough to be reliable in fast-rate sewing machines. This is best demonstrated when two pieces of thin fabric are being sewn together. Generally, measurements of the difference in thread consumption per stitch includes the thickness of two plies of fabric (assuming the stitch is set at center). For example, letting stitch length (SL)=0.124 inches, and ply thickness (PT)=0.01 inches, then the percentage decrease for a skipped stitch would be: 100* [(2* PT)/SL]=100 * [(2*0.010)/0.125]=16%. If thread tensions are not adjusted properly, this percent decrease could go to zero. Thus, there is a need for a direct, effective method of detecting skipped stitches in a fast-speed lockstitch type 30 sewing machine.

A primary shortcoming of the prior art is the unreliablity of these systems at high sewing speeds, for example greater than 5,500 stitches per minute. DeVita states that the apparatus disclosed therein makes "mechanically possible the very high running speeds of about 2,000 stitches per minute desirable for such [lockstitch] sewing machines" (emphasis added). These systems fail to detect a momentary reduction of thread tension when the sewing machine is operating at high sewing speeds. The reduction in tension for an improper stitch at high sewing speeds tends to be less and in a range that the prior art fails to detect. As a result, these systems tend to be less reliable and thus fail to perform these functions with great accuracy.

The Class 400 chainstitch is employed in a wide range of areas within the apparel industry because it provides a fast, economical, resilient, and strong stitch chain. The Class 400 stitch tends to be very elastic and is well suited for seaming operations, for example, inseaming pants and closing synthetic bags, on wovens and knits of many types and weights of materials. However, in Class 400 chainstitch, malformed or skipped stitching tend to weaken the entire stitch chain and, as a result when included in the final product, the defective product may prematurely fail, for example for unraveling.

The 400 Class "multi-thread chainstitch" is formed by a sewing machine passing one or more needle thread loops through the material. Those needle thread loops are interlooped on the underside with a looper thread supported on a looper. As an exemplary Class 400 chainstitch, stitch type 401 is formed with two threads, the needle thread and the looper thread. An angularly reciprocal looper, located underneath the material, engages the needle loop projected by an axially reciprocal needle underneath the material. The looper retains the needle loop the looper thread from the previous stitch through the needle loop The needle then penetrates the material again between the looper thread and the previous needle loop. As a result, when the looper retracts, the needle thread, which comprised the needle loop, tightens and thus completes a stitch. A more detailed description of the chainstitch type 401 is provided in Union "Special Stitch Formation Type 401" brochure, published by Union Special Huntley, Ill. (1979). Collectively, these malformed and skipped stitches are referred to as "improper stitches" hereinbelow. There are many causes of improper stitches. Malformed stitches can develop from improper synchronization between the active elements within the sewing machine and the needle and looper thread loops. In particular, the malformed stitches are formed when the needle thread loop around the blade of the looper is improperly positioned and as a result the needle on its downward travel can enter this loop, forming a "101-type" stitch.

In general, skipped stitches also result from improper synchronization of the needle thread loop and the looper thread loop and may also occur from deflection of the needle. There are primarily two types of skipped stitches: the "needle loop" skip and "triangle" skip. The needle loop skip develops when the looper fails to enter the needle loop and as a result the upward motion pull the loop to the top of the fabric. The triangle skip is formed not by the looper failing to enter the needle loop, but when the needle fails to enter the looper loop. Consequently, since the needle loop was picked up by the looper, the needle thread remains in the material or is loose on the top side of the fabric.

U.S. patent application Ser. No. 332,227 filed on Mar. 31, 1989, entitled "Method and Apparatus For Detecting Improper Stitches For A Chainstitch Sewing Machines," now U.S. Pat. No. 4,991,528, describes a method and apparatus for detecting improper stitches in a chainstitch sewing machine based upon thread consumption over the stitch formation cycle.

However, there continues to exist a need for better methods and systems for detecting skipped stitches for a chainstitch sewing machine that are reliable at high sewing speeds To accommodate the advances in the clothing automation, particularly the increase in sewing speeds, it is an object of the invention to provide a simple, reliable system for detecting skipped stitches that would satisfy a substantial need in the field.

SUMMARY OF THE INVENTION

Briefly, the invention is an apparatus for detecting improper stitch formation for a Class 400 chainstitch sewing machine. Generally, that type of machine has an axially reciprocal needle, a drive motor with an output shaft for driving the needle through at least one reciprocal motion per stitch, and a looper assembly including a reciprocable looper adapted for incorporating a looper thread into the chainstitches. The apparatus of the invention includes: a sensor for detecting drive shaft rotation for the sewing machine; a sensor for detecting looper thread movement and/or a sensor for detecting needle thread motion and a signal processing system for determining if a proper stitch is formed, based on the input from selected combinations of the sensors at certain temporal points during the stitch cycle.

BRIEF DESCRIPTION OF THE DRAWINGS

The foregoing and other objects of this invention, the various features thereof, as well as the invention itself, may be more fully understood from the following description, when read together with the accompanying drawings in which.

Figure 2:
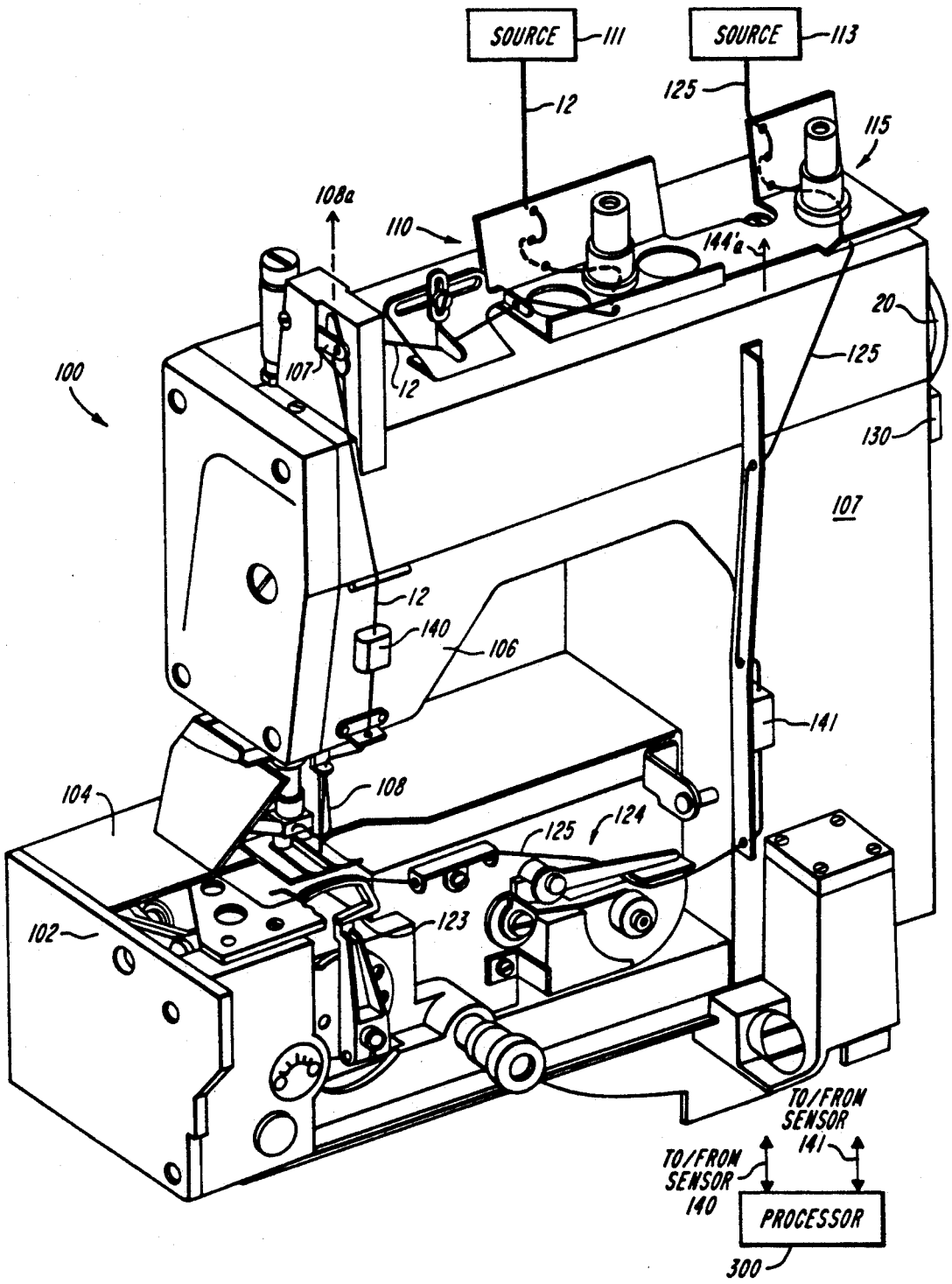
FIG. 2 shows, partially in cutaway view, a chainstitch sewing machine embodying the inventive apparatus.
Figure 9:
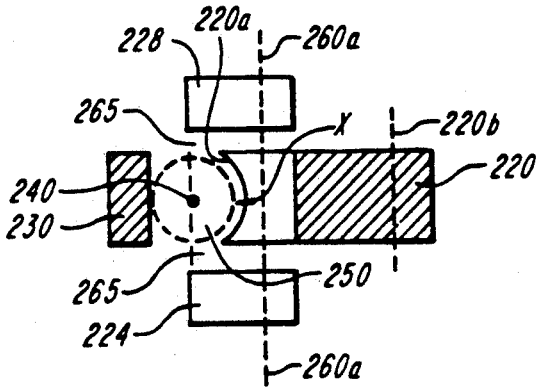
Figure 7:
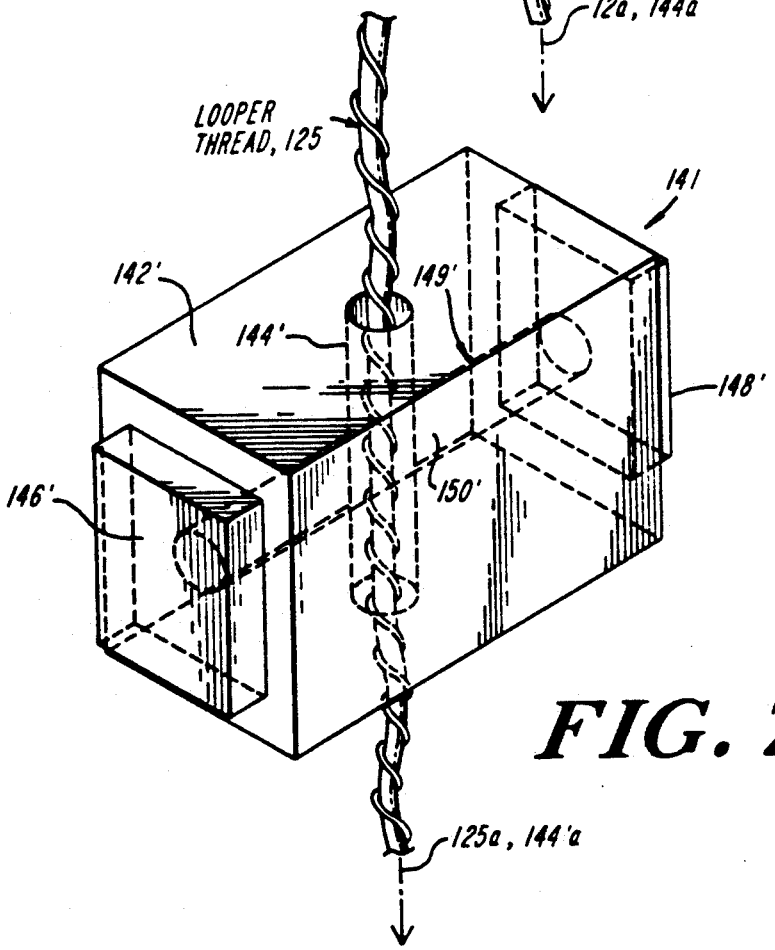
Figure 8:
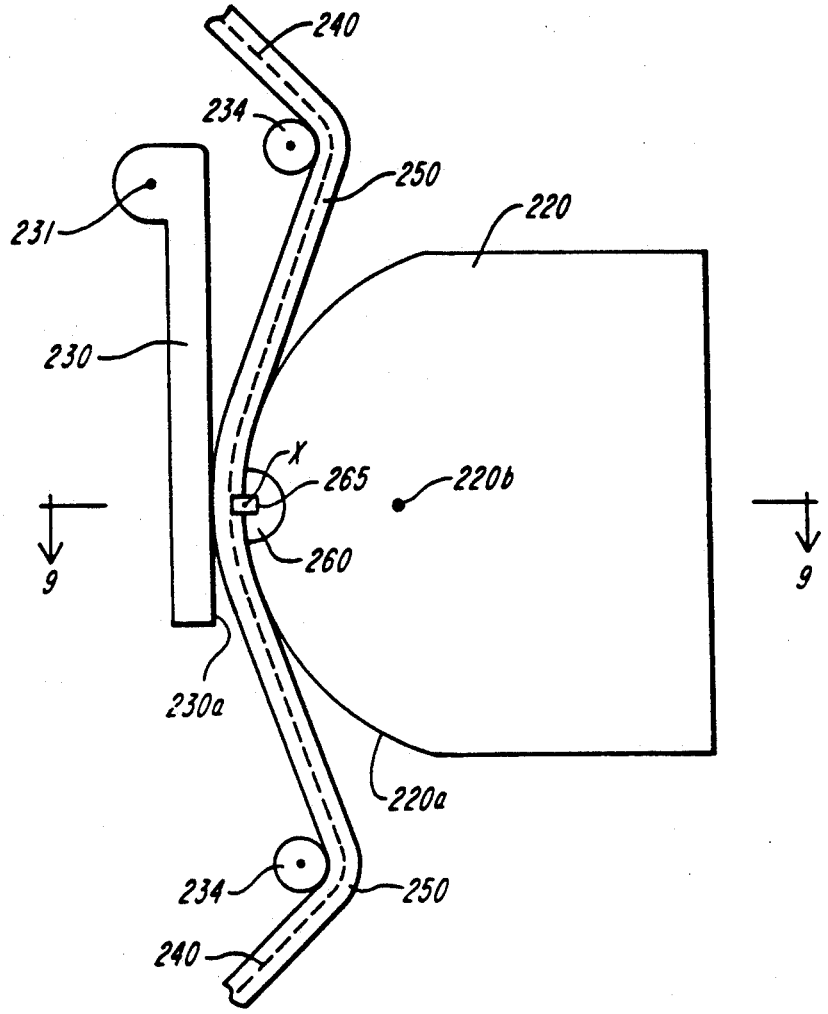

FIG. shows a perspective view of the needle thread movement sensor apparatus of the sewing machine of FIG. 2;

FIG. 7 shows a perspective view of the looper thread movement sensor apparatus of the sewing machine of FIG. 2;

FIG. 8 shows in side elevation a view of a alternative thread movement sensor; and FIG. 9 shows in section, the sensor of FIG. 8.

Like elements in each Figure have the same number.

DESCRIPTION OF THE PREFERRED EMBODIMENTS

Figure 1A:
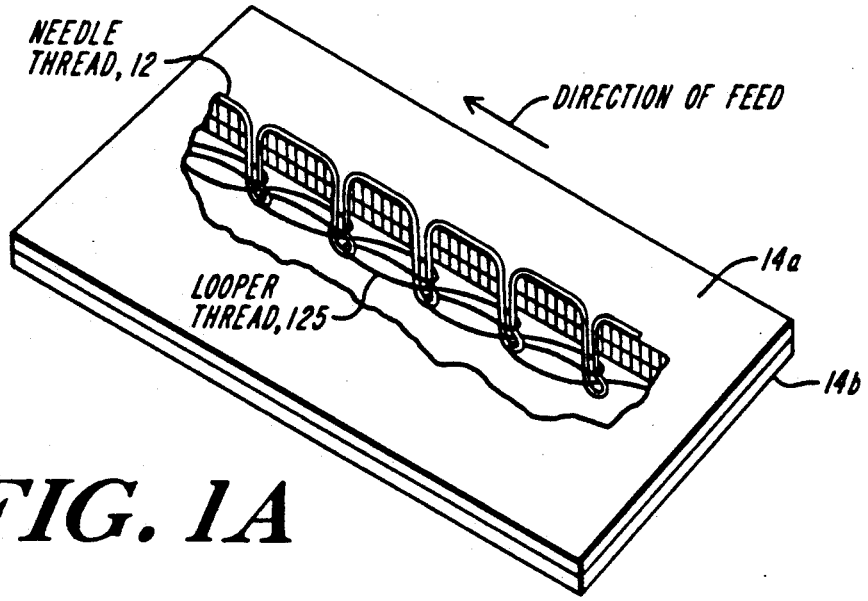
FIG. 1A shows in diagrammatic form an exemplary series of proper Class 400 chainstitches (type 401)

A diagrammatic representation of Class 400 chainstitches type 401 is shown in FIG. 1A. As shown, a needle thread 12 generally runs along the top of an upper limp material segment **14*a* passing loops through the segments 14*a* and 14*b* at periodic intervals. A looper thread 125 generally runs along the bottom of segment 14*b***, cyclically passing from one of the needle thread loops in each thread to the next and then returning to and passing around the first loop and continuing on to pass through the next needle thread loop of each thread. In the illustrated stitch configuration, the needle thread loops are shown with exaggerated length for clarity. When the finished stitch is at proper tension, there are several times as much looper thread as needle thread (for each needle) on a per stitch basis. For the chainstitch type 401, the ratio of looper thread to needle thread is approximately three.

The chainstitch type 401 is formed by passing the looper loop through the needle loop and then the needle loop through the looper loop or triangle. There are two basic types of skip stitches than can occur: the "needle loop" skip and the "triangle" skip.

Figure 1B:
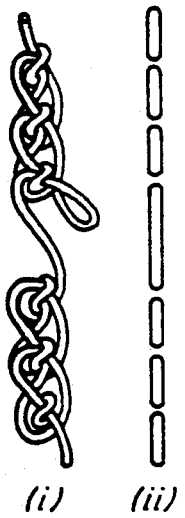
FIGS. 1B(i) and 1B(ii), show in diagrammatic form, the bottom and top, respectively, of an exemplary chainstitch type 401 having a needle loop skip improper stitch.

The needle loop skip (shown in FIGS. 1B, (i) and (ii)), may be identified by the needle thread laying tightly on the top side of the fabric and the looper thread twisted around the needle loop of the next properly formed stitch. The looper missing the needle loop is the cause of the skip. The upward motion of the needle, the needle thread controls, and feed motion pull the needle loop to the top of the fabric.

Figure 1C:
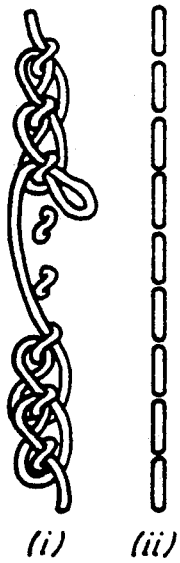
FIGS. 1C(i) and 1C(ii), show in diagrammatic form, the bottom and top, respectively, of an exemplary chainstitch type 401 having a triangle skip (looper thread side) improper stitch.
Figure 1D:
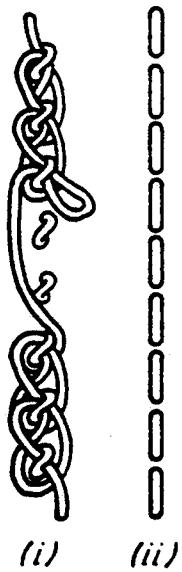
FIGS. 1D(i) and 1D(ii), show in diagrammatic form, the bottom and top, respectively, of an exemplary chainstitch type 401 having a triangle skip (needle loop side) improper stitch.

The triangle skip can occur on either the "looper thread side" (shown in FIGS. 1C, (i) and (ii)), of the triangle or the "needle loop side" (shown in FIGS. 1D, (i) and (ii)). Both triangle skips are usually identified by the needle thread loop remaining in the material or lying loosely on the top of the fabric. However, the looper thread of a skip on the "looper thread side" is not twisted around the needle loop of the next properly formed stitch. The looper thread of a skip on the "needle loop side" will be twisted around the needle loop. The needle missing the looper loop or triangle is the cause of this skip. Because the needle loop was picked up by the looper on the motion to the left, the needle thread remains in the material or is loose on the top side of the fabric.

In the production of other Class 400 chainstitches, similar "improper stitches" may also be formed.

One characteristic of each of the needle skip and triangle skip improper stitches is that there is a significant decrease in needle and/or looper thread consumption, i.e. thread movement, during particular time periods (or windows) during the stitch formation cycle, compared with the thread consumption during those time windows during formation of a proper stitch. Based upon this characteristic of such improper stitches, the present invention provides a method and apparatus for monitoring on a continuous basis the movement of needle and/or looper thread during appropriate time windows on a per stitch basis, and identifying times when this movement drops below a predetermined value indicative of the formation of needle and/or looper skip stitches. With the identification of such improper stitches, corrective action may subsequently be taken to ensure that high quality assembled workpieces are being produced.

The following description of a preferred embodiment is directed to a system for detecting needle and/or looper skip improper stitches in a chainstitch type 401, but similar devices and techniques may be used in accordance with the invention for detection of improper stitches in other Class 400 chainstitches.

FIG. 2 shows a conventional chainstitch type 401 sewing machine 100 that has been modified to include an embodiment of the present invention. Referring now to FIG. 2 generally, in the formation of normal or correct chainstitches, the looper assembly 124 of chainstitch sewing machine 100 brings the looper thread 125 proximal to the needle thread 12 during stitch formation. A proper or improper stitch can be detected preferably in selected time windows during each stitch cycle. Proper stitches are indicated by needle thread movement during a time window. Based upon the characteristics of such types of skipped stitches, the present invention provides an apparatus for monitoring, on a continuous basis, needle thread movement and looper thread movement during selected time windows of the stitch formation on a chainstitch sewing machine as correlated with the rotation of the main drive shaft of the machine, as an indicator of a skipped stitch.

FIG. 2 shows a side elevation cut-away view of a chainstitch sewing machine 100 including a skipped stitch detection system embodying the present invention. The sewing machine 100 includes a base member 102 having a planar workpiece support surface 104, and a sewing head 106 with a reciprocating (along needle axis 108*a*) needle 108 extending along axis 108*a*. The needle 108 receives needle thread 12 from a needle thread source 111 by way of a tension assembly 110.

The sewing machine 100 further includes a looper assembly 124 beneath support surface 104. The assembly 124 includes a reciprocating looper arm 123 distal to the looper thread feed assembly 122 that moves the looper thread 125 in position during stitch formation. The looper arm 123 receives looper thread 125 from a looper thread source 113 by way of a looper thread tension assembly 115.

As an important aspect of the invention, and as shown in FIG. 2, a needle thread movement sensor 140 of the invention is positioned, or mounted, on the sewing head 106 between the take-up lever 107 and the needle 108. In this location, the needle thread 12 passes through the thread movement sensor 140 (along axis 108*a*) to enable detection of needle thread movement during stitch formation. The exemplary sensor 140 is described in detail below in conjunction with FIG. 6.

Another important aspect of the invention is the inclusion of a looper thread movement sensor 141. The sensor 141 is positioned, or mounted, on the sewing machine body 107 between the looper assembly 124 and the looper thread tension assembly 115. Preferably, the sensor 141 is positioned close to the looper assembly 124 for more precise monitoring. In this location, the looper thread 125 passes through the looper thread movement sensor 141 (along axis 144'*a*) to enable detection of looper thread movement during stitch formation. The exemplary sensor 141 is described in detail below in conjunction with FIG. 7.

Also shown in FIG. 2 is a shaft monitor assembly 130 for detecting the rotation of the main shaft 20 of machine 100 during the formation of a stitch. The monitor assembly 130 may be any type of sensor assembly for detection of movement of the shaft 20.

In the preferred form of the shaft monitor assembly, a commercial sensor available from Sick Optic-Electronik, Inc., 2059 White Bear Avenue, St. Paul, Minn., may be used. Other commercially available sensors may be used. Generally, the sensor 130 includes a detector which provides a shaft output signal characterized by a pulse corresponding to the times light reflects back from a target positioned on the shaft 20 as the shaft rotates during each stitch cycle.

Figure 6:
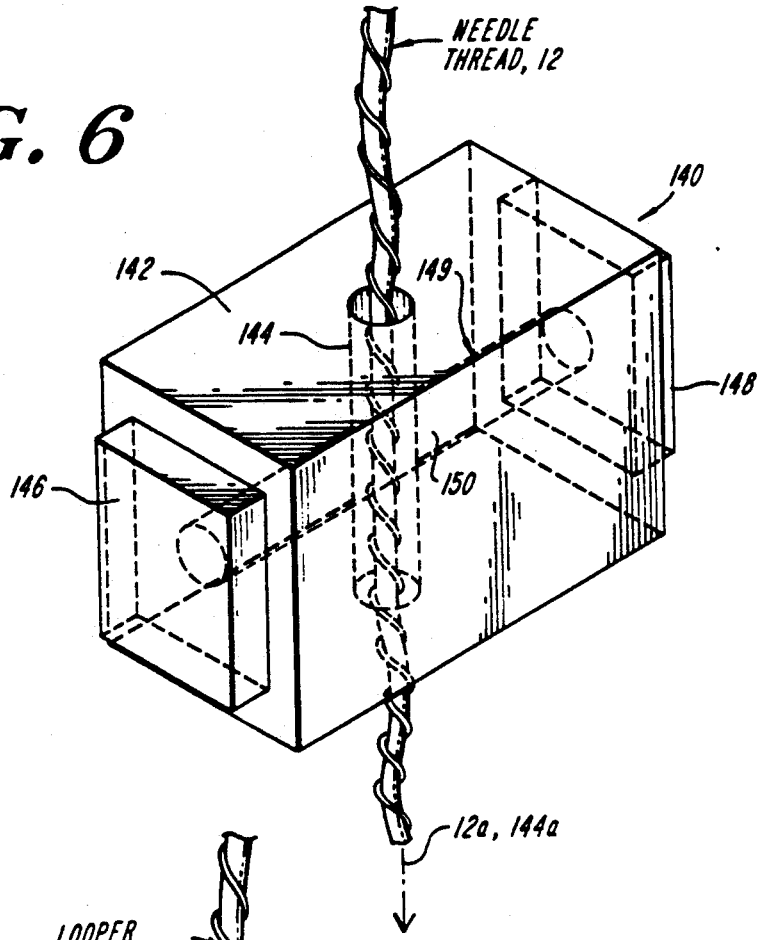

FIG. 6 shows a perspective view of one embodiment of the needle thread movement sensor 140 of the present invention. In the illustrated embodiment, the needle thread movement sensor 140 includes a housing 142 for mounting the sensor on the sewing head 106. At one side of the housing is an emitter 146, which may include a light emitting diode (LED) for generating a light beam 150 which is directed through a beam channel 149 within housing 142. In the illustrated embodiment, the beam 150 cross-section substantially matches the channel 149 cross-section, however some variation between beam widths may be permitted without impairing the functioning of the invention. At the other side of the housing, opposing the emitter 146, is located a detector 148, such as a phototransistor and associated circuitry (not shown). A thread channel 144 extends along an axis 144*a* and intersects the channel 149. Needle thread 12 passes through channel 144 on its way to the needle with the thread's longitudinal axis 12*a* substantially parallel to axis 144*a*. While the exact orientation of the beam 150 is not critical to the invention, it is essential that at least a portion of the needle thread 12 is constantly located at least partially within the beam 150. Thread movement is indicated by detected changes in reflection or absorption of the beam 150 as the thread 12 passes through the beam 150 where such changes are due to variation in the thread characteristics (e.g., reflection or absorption) along its principal axis 12*a*. In an alternate form of the invention, thread movement is detected by detected changes in beam intensity due to variations in surface texture of the thread 12 along its principal axis 12*a*.

An exemplary looper thread movement sensor 141 of the present invention is shown in FIG. 7. That sensor 141 is similar in construction to the needle thread movement sensor 140 of FIG. 6. Similar elements of that sensor are identified with the same (but primed) reference designations as used in FIG. 6. Specifically, the illustrated sensor 141 includes a housing 142' for mounting the sensor 141 on the sewing machine body 107. At one side of the housing 142' is an emitter 146', which may include an LED for generating a light beam 150' that is directed through a beam channel 149' within the housing 142'. A detector 148' is disposed opposite to the emitter 146'. The looper thread 125 passes through the channel 144' (with the thread's longitudinal axis 125*a* substantially parallel to axis 144'*a*) on its way to the looper assembly 124. The sensor 141 functions in substantially the same manner as the needle thread movement sensor 140 described above.

In an alternative embodiment, either or both of sensors 140 and 141 may have the form of the thread movement sensor 140A shown in FIGS. 8 and 9.

Sensor 140A includes a guide block 220, a beam generator 224, a beam detector 228, a pressure arm 230, and thread guide pins 232 and 234. Guide block 220 and pins 232 and 234 establish an elongated region 250 along a zig-zag feed axis 240 adapted to receive and allow passage therethrough of a thread-to-be-monitored, where the region 250 for thread passage includes a point X on its lateral boundary. Preferably, feed axis 240 lies substantially in a plane.

The guide block 220 has a generally convex (about a block axis 220*b* perpendicular to the feed axis 240) lateral surface 220*a* that is substantially tangent to region 250 near point X.

In the illustrated embodiment, the lateral surface 220*a* has a slight concave groove (about an axis parallel to the feed axis) at points close to the point X, to provide a guide to control the transverse (to feed axis 240) position o f a thread passing through region 250. The lateral surface 220*a* of block 220 and pins 232 and 234 (which extend in a direction perpendicular to the plane of feed axis 240) generally define the shape of region 250.

The pressure arm 230 is pivotally mounted about axis 231 (perpendicular to the plane of feed axis and is spring loaded so that its lateral surface 230*a* opposite point X is biased toward block 220. The pressure arm 230 is optional, but when used, is adapted to affirmatively bias thread passing through region 250 toward point X, regardless of the diameter of the thread.

The guide block 220 includes an open-sided channel (or groove) 260 extending across surface 220 transversely along a channel axis The beam generator 224 and beam detector 228 face each other, with beam generator 224 being positioned at one end of channel 260 and the beam detector 228 being positioned at the other end. The generator 224 generates an optical beam 265 and transmits that beam along channel axis 260*a* onto detector 228, where the beam cross-section includes a region within channel 260 (including point X) and the region adjacent thereto within region 250.

With this configuration, as a thread passes through region 250 along feed axis 240, the lateral surface of the thread travels along surface 230*a* and Passes Point X. As it does so, the edge portion of the thread interrupts a portion of the beam 265, where the interrupted portion varies as a function of the shape of the profile (shape) of the lateral surface of the thread as it Passes the channel 260. The detector 228 includes a photodetector circuit that generates a signal representative of the variation in detected beam intensity incident thereon. This signal varies directly with the variation in the profile of the thread passing channel 260.

Figure 3:
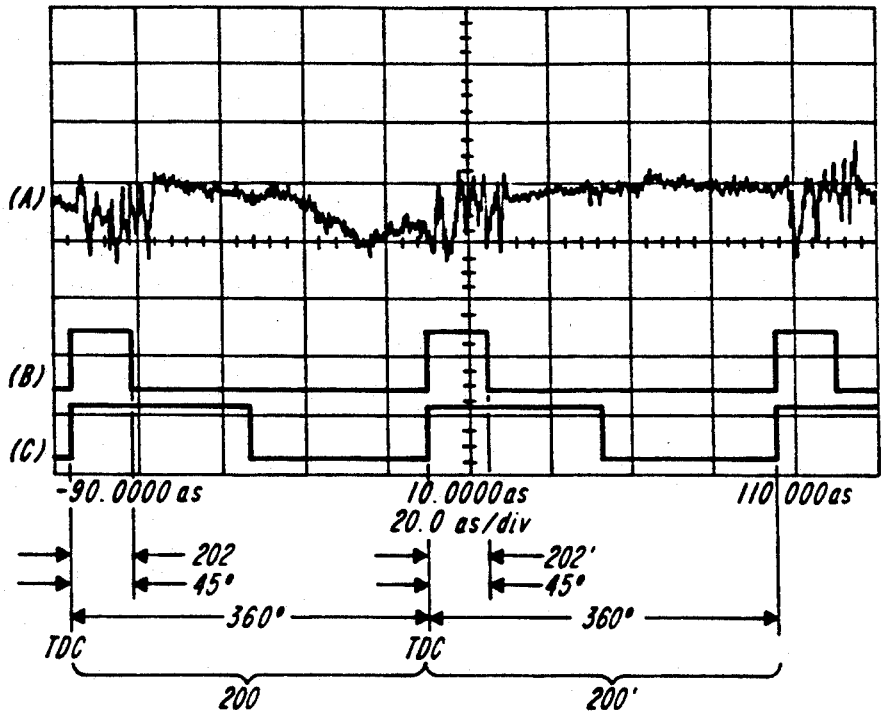
FIG. 3 shows (A) an output signal for a good stitch, generated by the sensor assembly of the looper thread movement sensor; (B) an output signal generated by the signal processing system of the embodiment of FIG. 2, indicating the time window (45 deg) during which the looper thread movement is monitored; (C) an output signal representative of drive shaft rotation.

FIG. 3 shows an output signal generated by the looper thread sensor assembly 141 for a proper chainstitch (Trace A) and an output signal generated by processor 300 representative of time windows when looper thread movement is monitored (TRACE B), and versus an output voltage signal generated by shaft rotation sensor 130 (Trace C) on a common time axis. Trace C shows a single pulse representative of top dead center (TDC) of the shaft 20 of machine 100. Variations in the voltage level in Trace A are indicative of looper thread movement, as measured by an embodiment of the present invention. Trace C defines successive stitch cycles 200 and 200', as indicated by shaft rotation, measured using the shaft sensor 130.

Time windows 202 and 202' are indicated in FIG. 3, with windows 202 202' being associated with a first predetermined portion of stitch cycles 200, 200', i.e. the first 45 degrees from top dead center (TDC) of the cycle, for illustrated cycles 200 and 200'. The windows 202 and 202' represent the times when looper thread movement is monitored by Processor 300 during cycles 200 and 200', respectively. Looper thread movement during one of these windows is indicative of no triangle skip improper stitch during the corresponding cycle, while no looper thread movement is indicative of a triangle improper stitch Trace A indicates that there is looper thread movement during both time windows 202 and 202'. This is indicative no triangle skip improper stitches during cycles 200 and 200'.

Figure 4:
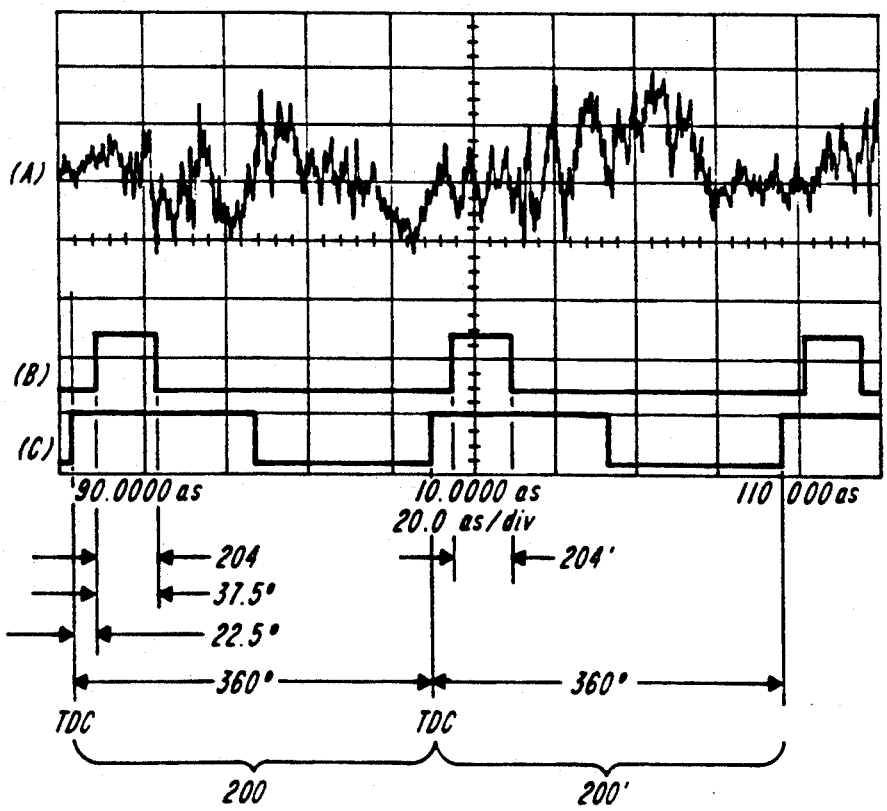
FIG. 4 shows (A) an output signal for a good stitch, generated by the sensor assembly of the needle thread movement sensor; (B) an output signal generated by the signal processing system of the embodiment of FIG. 2, indicating the time window (37.5 deg) during which the needle thread movement is monitored; (C) an output signal representative of drive shaft rotation.

FIG. 4 shows an output signal generated by the needle thread sensor assembly 140 for a proper chainstitch (Trace A) and an output signal generated by processor 300 representative of time windows when needle thread movement is monitored (Trace B), and versus an output voltage signal generated by shaft rotation sensor 130 (Trace C) on a common time axis. As in FIG. 3, Trace C shows a single pulse representative of top dead center (TDC) of the shaft 20 of machine 100. Variations in the voltage level in Trace A are indicative of needle thread movement, as measured by an embodiment of the present invention.

Two time windows 204 and 204' are indicated in FIG. 4, with windows 204 and 204 being associated with a second predetermined portion of the stitch cycles 200, 200', i.e. the first 37.5 degree portion of the cycle occurring after the first 22.5 degrees after TDC of the cycle. The windows 204 and 204' represent the times when needle thread movement is monitored by processor 300 during cycles 200 and 200', respectively. Needle thread movement during one of those windows is indicative of no needle loop skip improper stitch during the corresponding cycle, while no needle thread movement is indicative of a needle loop improper stitch. Trace A indicates that there is needle thread movement during both time windows 204 and 204'. This is indicative no needle loop skip improper stitches during cycles 200 and 200'.

Figure 5:
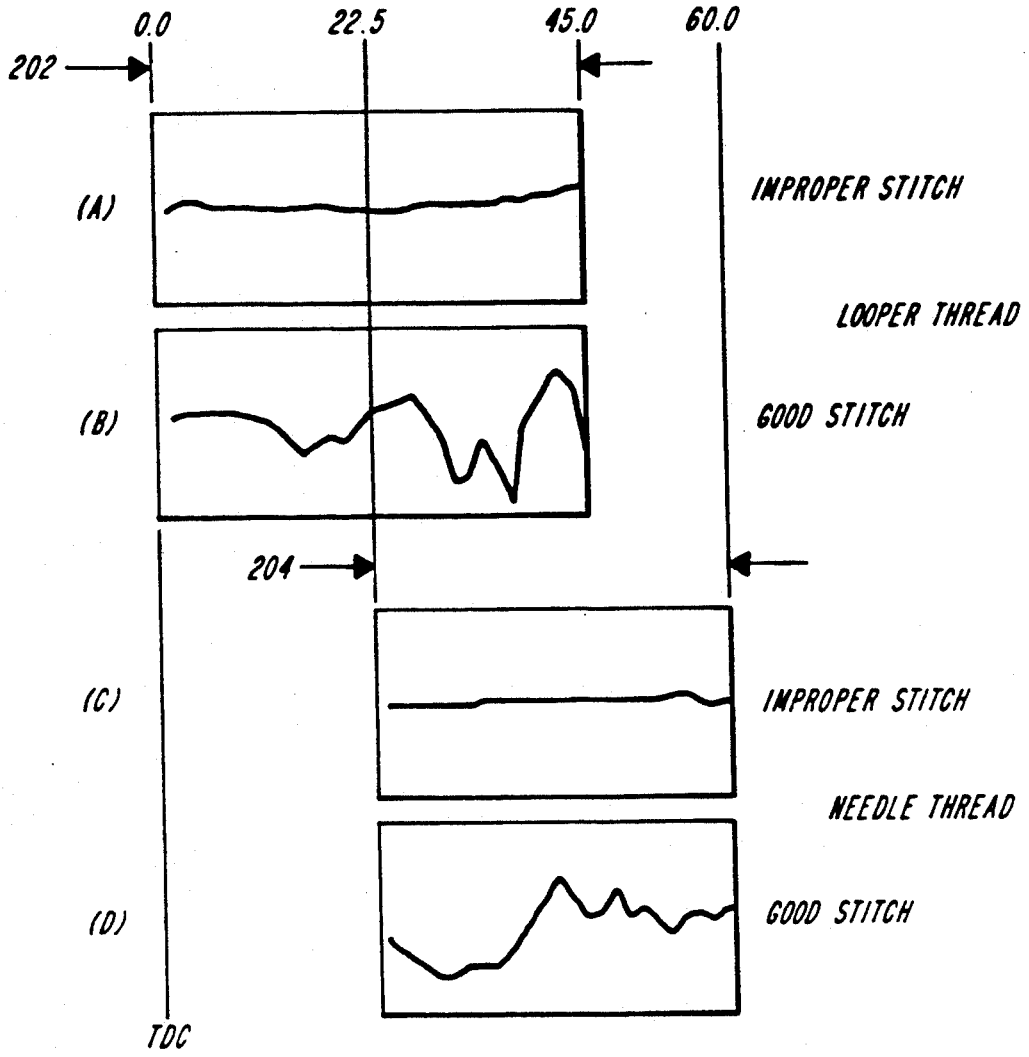
FIG. 5 shows (A) an output signal for an improper stitch, generated by the sensor assembly of the looper thread movement sensor; (B) an output signal for a good stitch, generated by the sensor assembly of the looper thread movement sensor; (C) an output signal for an improper stitch, generated by the sensor assembly of the needle thread movement sensor; (D) an output signal for a good stitch, generated by the sensor assembly of the needle thread movement sensor.

FIG. 5 shows signals from the sensor 141 (Traces A and B) and from the sensor 140 (Traces C and D) for segments of a stitch cycle. Trace A shows the window 202 for a triangle skip improper stitch (showing substantially no looper thread movement) while, in contrast, Trace B shows the window 202 for a proper stitch (showing looper thread movement substantially throughout the window 202).

Also in FIG. 5, Trace C shows the window 204 for a needle loop improper stitch (showing substantially no needle thread movement) while, in contrast, Trace D shows the window 204 for a proper stitch (showing needle thread movement substantially throughout the window 204).

The measurements shown in FIGS. 4 and 5 are for sewing speeds at 700 rpm (SPM, stitches per minute) at 10 stitches per inch. Thus, one stitch cycle (TDC-to-TDC) occurs in approximately 86 milliseconds.

During operation of the sewing machine of the illustrated embodiment of FIG. 2, the needle thread movement sensor 140 and the looper thread movement sensor 141 each maintain a constant beam 150, 150' through which the respective threads move during stitch formation, and generate needle and looper thread movement signals respectively. The shaft monitor 130 generates a stitch signal similar to those shown in Trace A of FIGS. 3 and 4 (and Traces A and C of FIG. 5 for instances of improper stitches). A signal processing system (or processor) 300 stores, processes, and correlates the information received from the shaft monitor 130, the looper thread movement sensor 141, and the thread movement sensor 140 to determine whether an improper stitch was formed during each stitch cycle. If there is no movement, or substantially no movement, of thread during a predetermined segment of a stitch cycle (i.e. window), a signal will be generated for notifying the sewing machine operator of a skip stitch. The sewing machine operator may either be a human operator or a computer/machine operator depending upon the technology available at the time. The processor 300 may in some embodiments store values corresponding to appropriate thread movement rates for certain stitching operations, and may compare those values with actual (needle and/or looper) thread movement during selected portions of the stitch cycle.

Either thread movement sensor may be used without the correlation of the shaft monitor to merely detect the movement of the respective threads for the purpose of thread break detection. However, during high-speed operation of sewing machines, such as occurs in large-scale production of apparel, it is important to have real-time detection of skipped stitches detected during each stitch cycle. Prompt, accurate detection of skipped stitches is important in such applications.

In practicing the system of the present invention, the different sensors may be used to detect specific types of skipped stitches. For example, when using the needle thread movement sensor 140 and shaft rotation sensor 130 without a looper thread movement sensor 141, needle loop skip stitches may be detected, however triangle skip stitches may not be detected. Conversely, use of a looper thread movement sensor 141 and shaft rotation sensor 130 without a needle thread movement sensor 140 will detect triangle skip stitches, but will not effectively detect needle loop skip stitches. Thus, to detect both types of skipped stitches, i.e., needle loop skip and triangle skip, all three sensors 140, 141, 130 should be used.

While the invention is discussed above in relation to chainstitch-forming sewing machines, the invention may be used in monitoring the formation of other stitches, such as those requiring the use of a bobbin.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. In an apparatus for detecting an improper stitch used in conjunction with a chainstitch sewing machine, said machine including:

an axially reciprocal needle adapted to receive at least one needle thread and form a succession of stitches, said needle being movable along a longitudinal needle axis;

a reciprocal needle thread take-up lever;

a drive motor having an output shaft, and means associated with said shaft for driving said needle through at least one reciprocal motion per stitch; and a looper thread assembly including looper means for incorporating a looper thread to said needle thread when forming said stitches during one stitch cycle, and a looper thread tension assembly and associated delivery means for delivering said looper thread to said looper means, said looper thread being disposed in part along a looper thread axis extending between said looper thread tension assembly and said looper means; the improvement in the apparatus comprising:

a) looper thread detection means for detecting looper thread movement along said looper thread axis between said looper thread tension assembly and said looper means during a predetermined portion of said stitch cycle;

b) shaft rotation detecting means for detecting rotations of said output shaft; and c) first signal generating means responsive to said looper thread detection means and said shaft rotation detector means for generating a first stitch signal corresponding to detection of substantially no looper thread movement during said predetermined portion of said stitch cycle, said first stitch signal being indicative of formation of an improper stitch.

2. The improvement according to claim 1 wherein said looper thread detection means comprising:

i) a detector housing having a channel extending therethrough along a channel axis for receiving said looper thread between said looper thread tension assembly and said looper means, wherein, in said channel, said looper thread axis is substantially aligned with said channel axis;

ii) beam generating means positioned on one side of said channel for generating an optical beam of predetermined width transverse to said channel axis and intersecting at least a portion of said channel; and iii) means for controlling a position of said looper thread in said channel so that said thread passes through at least a portion of said beam, iv) beam detection means positioned on a side of said channel opposite said beam generating means for detecting said optical beam;

whereby movement of said looper thread through said optical beam is detected due to differences in thread characteristics along a length of said thread.

3. The improvement according to claim 2 wherein said channel is of sufficient size to substantially constrain movement of said looper thread within a predetermined region, said region being determined by said predetermined width of said beam.

4. The improvement according to claim 3 further comprising means for storing predetermined values corresponding to thread movement during said predetermined portion of said stitch cycle.

5. The improvement according to claim 4 further comprising means for comparing said stored values with thread movement during said predetermined portion of said stitch cycle.

6. The improvement according to claim 3 further comprising means for generating an output signal representative of said first stitch signal.

7. The improvement according to claim 1 further comprising:

d) needle thread detection means for detecting needle thread movement along said needle thread axis between said take-up lever and said needle during a second predetermined portion of said stitch cycle;

e) second signal generating means responsive to said needle thread detection means for generating a second stitch signal corresponding to detection at substantially no needle thread movement during said second predetermined portion of said stitch cycle, said second stitch signal being indicative of formation of an improper stitch.

8. The improvement according to claim 7 wherein said needle thread detection means further comprising:

a) a detector housing having a channel extending therethrough along a channel axis for receiving said needle thread between said take-up lever and said needle, wherein, in said channel, said needle thread axis is substantially aligned with said channel axis;

b) beam generating means positioned on one side of said channel for generating an optical beam of predetermined width and transverse to said channel axis and intersecting at least a portion of said channel;

c) means for controlling a position of said needle thread in said channel so that said thread passes through at least a portion of said beam; and d) beam detection means positioned on a side of said channel opposite said beam generating means for detecting said optical beam;

whereby movement of said needle thread through said optical beam is detected due to differences in thread characteristics along a length of said thread.

9. The improvement according to claim 8 wherein said channel is of sufficient size to substantially constrain movement of said looper thread within a predetermined region, said region being determined by said predetermined width of said beam.

10. The improvement according to claim 9 further comprising means for storing predetermined values corresponding to thread movement during said predetermined portion of said stitch cycle.

11. The improvement according to claim 10 further comprising means for comparing said stored values with actual thread movement during said predetermined portion of said stitch cycle.

12. The improvement according to claim 9 further comprising means for generating an output signal representation of said second stitch signal.

13. In an apparatus for detecting an improper stitch used in conjunction with a chainstitch sewing machine, said machine including:

an axially reciprocal needle adapted to receive at least one needle thread and form a succession of stitches, said needle being movable along a longitudinal needle axis;

a reciprocal needle thread take-up lever;

a drive motor having an output shaft, and means associated with said shaft for driving said needle through at least one reciprocal motion per stitch;

a looper thread assembly including looper means for incorporating a looper thread to said needle thread when forming said stitches during one stitch cycle, and a looper thread tension assembly and associated delivery means for delivering said looper thread to said looper means, said looper thread being disposed in part along a looper thread axis extending between said looper thread tension assembly and said looper means the improvement in the apparatus comprising:

a) needle thread detection means for detecting needle thread movement along said needle thread axis between said take-up lever and said needle during a predetermined portion of said stitch cycle;

b) shaft rotation detecting means for detecting rotations of said output shaft; and c) signal generating means responsive to said needle thread detection means and said shaft rotation means for generating a stitch signal corresponding to detection of substantially no needle thread movement during said predetermined portion of said stitch cycle, said stitch signal being indicative of formation of an improper stitch.

14. The improvement according to claim 13 wherein said needle thread detection means further comprising:

i) a detector housing having a channel extending therethrough along a channel axis for receiving said needle thread between said take-up lever and said needle, wherein, in said channel, said needle thread axis is substantially aligned with said channel axis;

ii) beam generating means positioned on one side of said channel for generating an optical beam of predetermined width transverse to said channel axis and intersecting at least a portion of said channel;

iii) means for controlling a position of said needle thread in said channel so that said thread passes through at least a portion of said beam; and iv) beam detection means positioned on a side of said channel opposite said beam generating means for detecting said optical beam;

whereby movement of said needle thread through said optical beam is detected due to differences in thread characteristics along a length of said thread.

15. The improvement according to claim 14 wherein said channel is of sufficient size to substantially constrain movement of said looper thread within a predetermined region, said region begin determined by said predetermined width of said beam.

16. The improvement according to claim 15 further comprising means for storing predetermined values corresponding to thread movement during said predetermined portion of said stitch cycle.

17. The improvement according to claim 16 further comprising means for comparing said stored values with thread movement during said predetermined portion of said stitch cycle.

18. The improvement according to claim 15 further comprising means for generating an output signal representation of said stitch signal.

19. A method for detecting a needle loop skip during chainstitch formation using a chainstitch sewing machine, said machine including:

an axially reciprocal needle adapted to receive at least one needle thread and form a succession of stitches where each stitch is formed during a stitch cycle, said needle being movable along a longitudinal needle axis;

a reciprocal needle thread take-up lever;

a drive motor having an output shaft, and means associated with said shaft for driving said needle through at least one reciprocal motion per stitch;

a looper thread assembly including looper means for incorporating a looper thread to said needle thread when forming said stitches during one stitch cycle, and a looper thread tension assembly and associated delivery means for delivering said looper thread to said looper means, said looper thread being disposed in part along a looper thread axis extending between said looper thread tension assembly and said looper means; said method comprising the steps of:

a) detecting needle thread movement along a portion of a needle thread axis extending between said needle and said take-up lever during a predetermined portion of each stitch cycle;

b) detecting each shaft rotation during each said stitch cycle;

c) correlating said needle thread movement and said shaft rotation during said stitch cycle to identify instances of substantially no needle thread movement; and d) generating a signal representative of said instances of substantially no needle thread movement, said signal being indicative of a needle loop skip.

20. The method of claim 19 wherein said step of detecting said needle thread movement further comprises the step of detecting differences in thread surface characteristics as at least a portion of said needle thread passes through an optical beam, whereby said optical beam is generated by a beam generator, passes through a beam channel that is at least partially transverse to a thread channel through which said needle thread passes, and is detected by a beam detector means opposite said beam generator.

21. A method for detecting a triangle loop skip during chainstitch formation using a chainstitch machine, said machine including:

an axially reciprocal needle adapted to receive at least one needle thread and form a succession of stitches where each stitch is formed during a stitch cycle, said needle being movable along a longitudinal needle axis;

a reciprocal needle thread take-up lever;

a drive motor having an output shaft, and means associated with said shaft for driving said needle through at least one reciprocal motion per stitch;

a looper thread assembly including looper means for incorporating a looper thread to said needle thread when forming said stitches during one stitch cycle, and a looper thread tension assembly and associated delivery means for delivering said looper thread to said looper means, said looper thread being disposed in part along a looper thread axis extending between said looper thread tension assembly and said looper means;

said method comprising the steps of:

a) detecting looper thread movement along a portion of a looper thread axis extending between said looper thread tension assembly and said looper means during a predetermined portion of each stitch cycle;

b) detecting each shaft rotation during each said stitch cycle;

c) correlating said looper thread movement and said shaft rotation during said stitch cycle to identify instances of substantially no looper thread movement; and d) generating a signal representative of said instances of substantially no looper thread movement, said signal being indicative of a triangle loop skip.

22. The method of claim 21 wherein said step of detecting said looper thread movement further comprises the step of detecting differences in thread surface characteristics as at least a portion of said looper thread passes through an optical beam, whereby said optical beam is generated by a beam generator, passes through a beam channel that is at least partially transverse to a thread channel through which said looper thread passes, and is detected by a beam detector means opposite said beam generator.

23. The improvement according to claims 1 or 7 or 13 wherein said looper thread detection means comprising:

i) thread positioning means for establishing an elongated region extending along a thread feed axis and adapted to position said thread with a thread principal axis substantially parallel to said feed axis with a lateral surface of said thread adjacent to a lateral boundary of said region at a reference point on said lateral boundary, ii) a beam guide including a block member having a lateral surface substantially tangent to said lateral boundary of said region near said reference point, said block member including an open-sided channel in said lateral surface and passing through said reference point, said channel extending along a linear channel axis, said channel axis being other than parallel to said feed axis, iii) a beam generator disposed at one end of said channel and including means for transmitting an optical beam in a direction parallel to said channel axis toward another end of said channel, said beam having a cross-section, and iv) a beam detector disposed at the other end of said channel and including means for detecting portions of said beam incident thereon from said channel and regions adjacent thereto, and including means responsive to said detection for generating a signal representation of the intensity of the optical beam incident on said detecting means, said signal being representative of the variation in the lateral surface of thread passing through said region in the direction of said feed axis.

24. The improvement of claim 23 wherein said lateral surface of said block member is convex about a block axis extending in a direction other than parallel to said feed axis.

25. The improvement of claim 24 wherein said block axis extends in a direction substantially perpendicular to said feed axis.

26. The improvement of claim 25 wherein said thread positioning means includes means for defining said feed axis to curve around said convex lateral surface of said block member.

27. The improvement of claim 23 wherein said thread positioning means includes an arm having a pressure surface on a side of said region opposite said reference point, and includes means for biasing said pressure surface toward said reference point.

28. Apparatus for detecting motion of a thread in a direction of a thread principal axis, said thread having an irregular lateral surface, comprising:

a) thread positioning means for establishing an elongated region extending along a thread feed axis and adapted to position said thread with a thread principal axis substantially parallel to said feed axis with a lateral surface of said thread adjacent to a lateral boundary of said region at a reference point on said lateral boundary, b) a beam guide including a block member having a lateral surface substantially tangent to said lateral boundary of said region near said reference point, said block member including an open-sided channel in said lateral surface and passing through said reference point, said channel extending along a linear channel axis, said channel axis being other than parallel to said feed axis, c) beam generator disposed at one end of said channel and including means for transmitting an optical beam in a direction parallel to said channel axis toward another end of said channel, said beam having a cross-section including the portion of said region adjacent to said channel, and d) beam detector disposed at the other end of said channel and including means for detecting portions of said beam incident thereon from said channel and regions adjacent thereto, and including means responsive to said detection for generating a signal representation of the intensity of the optical beam incident on said detecting means, said signal being representative of the variation in the lateral surface of thread passing through said region in the direction of said feed axis.

29. The apparatus of claim 28 wherein said lateral surface of said block member is convex about a block axis extending in a direction other than parallel to said feed axis.

30. The apparatus of claim 29 wherein said block axis extends in a direction substantially perpendicularly to said feed axis.

31. The apparatus of claim 30 wherein said thread positioning means includes means for defining said feed axis to curve around said convex lateral surface of said block member.

32. The apparatus of claim 28 wherein said thread positioning means includes an arm having a presser surface on a side of said region opposite said reference point, and includes means for biasing said presser surface toward said reference point.

* * * * *